US006877783B2

(12) United States Patent
Atkinson et al.

(10) Patent No.: US 6,877,783 B2
(45) Date of Patent: Apr. 12, 2005

(54) LATCH

(75) Inventors: Paul Edward Atkinson, Sileby (GB); Jonathan Rodger Laws, Fleckney (GB)

(73) Assignee: Allgood Holdings Limited (GB)

( * ) Notice: Subject to any disclaimer, the term of this patent is extended or adjusted under 35 U.S.C. 154(b) by 13 days.

(21) Appl. No.: 10/399,249

(22) PCT Filed: Jul. 3, 2002

(86) PCT No.: PCT/GB02/03078

§ 371 (c)(1),
(2), (4) Date: Apr. 15, 2003

(87) PCT Pub. No.: WO03/004813

PCT Pub. Date: Jan. 16, 2003

(65) Prior Publication Data

US 2004/0094967 A1 May 20, 2004

(30) Foreign Application Priority Data

Jul. 3, 2001 (GB) ..... 01162296

(51) Int. Cl.[7] ..... E05C 1/12
(52) U.S. Cl. ..... 292/171; 292/337
(58) Field of Search ..... 292/337, 171, 292/141

(56) References Cited

U.S. PATENT DOCUMENTS 238,627 A * 3/1881 Wolfrath ..... 292/167
2,541,723 A * 2/1951 Shaw et al. ..... 70/470
3,853,341 A 12/1974 MacDonald ..... 292/171
4,012,066 A * 3/1977 Salvatore ..... 292/341.13
4,691,948 A * 9/1987 Austin et al. ..... 292/171
4,871,202 A 10/1989 Friedrichs et al. ..... 292/169
5,501,492 A * 3/1996 Kajuch ..... 292/1.5

FOREIGN PATENT DOCUMENTS

| | | | |
|---|---|---|---|
| DE | 513087 | 11/1930 | |
| DE | 634934 | 9/1936 | |
| DE | 1018745 | 10/1957 | |
| GB | 450580 | 7/1936 | |
| GB | 555705 | 3/1943 | |
| GB | 1185641 | 3/1970 | ..... E05C/1/16 |

* cited by examiner

*Primary Examiner*—Gary Estremsky
(74) *Attorney, Agent, or Firm*—Young & Basile, P.C.

(57) ABSTRACT

A door latch comprises a follower mounted for rotational movement in a latch housing, a guide pin provided on an actuating arm of the follower which is operatively linked to a multiplier, a bolt biased outwards of the housing, and an inelastic flexible element connected between the multiplier and bolt. In operation rotational movement of the follower is amplified by the guide pin acting on the multiplier. The increased rotational movement of the multiplier is converted to rectilinear movement of the bolt into the housing by the inelastic flexible element, which wraps around an outside edge of the multiplier.

15 Claims, 4 Drawing Sheets

LATCH

The present invention relates to a latch and more particularly, but not exclusively, to a door latch for use in a domestic or commercial application.

A conventional door latch comprises a housing, known as a lock case, with a bolt biased out of a fore end of the housing. A follower mounted for rotation within the housing converts rotational movement from a handle mounted externally of the housing, to rectilinear movement of the bolt in a direction into the fore end of the housing.

One conventional door latch housing is substantially rectangular in cross section, and therefore requires an elongate mortise to be chiselled or machined in the edge of the door to receive the housing during fitting. Holes are drilled in either side of the door, perpendicular to, and in communication with the elongate mortise for receiving a square section latch driving spindle which is connected in driving engagement between door handles on either side of the door and the follower.

In order to attach the latch housing to the door, a plate is mounted at the fore end of the housing, and woodscrews are driven through holes provided in the plate into the edge of the door. The surface of the plate facing outwards of the door is fitted flush with the door edge, and consequently a recess must first be chiselled in the edge of the door to receive the depth of the plate. Preparation of a door for the fitting of a latch requires the labour of a skilled tradesman, and is therefore costly. The majority of the work is usually carried out by hand, and the risk of making an error, resulting in the scrapping of a door is high.

Typically, when opening a door fitted with a conventional door latch, the door handle must be moved through a significant arc in order to withdraw the bolt into the latch housing, which may be 60° or more.

It is an object of the invention to provide a door latch which is easier to fit and operate than a conventional door latch of the kind described above.

According to the present invention there is provided a door latch comprising a follower mounted for rotational movement in a latch housing, a multiplier operatively linked to the follower for amplifying rotational movement of the follower, a bolt biased outwards of the housing, and an inelastic flexible element connected between the multiplier and bolt for converting rotational movement of the multiplier to rectilinear movement of the bolt.

It is an advantage of the invention that the latch housing can be fitted in a circular bore, which negates the need for skilled chiselling of a door during fitting of the latch. It is a further advantage that when opening a door fitted with a door latch of the invention, the door handle need only be moved through an arc of 20°.

Preferably, the follower has a spring arm and an actuating arm extending from opposite sides of a central hub. The hub preferably locates in circular apertures provided in either side of the latch housing. A square aperture may be provided through the follower in axial alignment with the hub for receiving a square section latch driving spindle of a door handle in conventional manner.

Preferably, a guide pin is mounted on the actuating arm of the follower, and the multiplier is provided with a pin guide surface. The pin guide surface may be straight or curved, but is preferably evolute. The guide pin preferably cams against the pin guide surface.

The multiplier is preferably mounted for rotation about a pivot.

One end of the inelastic flexible element may be connected to the bolt by means of a ball and socket joint. The other end of the inelastic flexible element may be provided with a substantially circular enlargement, which is received and retained in a correspondingly shaped recess in the multiplier.

Preferably, the inelastic flexible element is provided with a ball or cylindrical member, which engages in a socket provided in the bolt. The ball or cylindrical member may be located in the socket during assembly of the joint as a snap fit.

Preferably, a circular recess is provided in the end of the bolt, which receives a spring for biasing the bolt outwards of the housing. The spring reacts against an internal wall of the housing. The socket may extend from the circular recess into the bolt, and is preferably concentric with the recess.

The multiplier has an outside edge which may be straight or curved, but is preferably involuted. During opening of the latch, the inelastic flexible element may wrap around the involuted outside edge of the multiplier.

A handle return spring may be provided which acts between the spring arm of the follower and the housing. The handle return spring preferably biases the follower towards a position in which the bolt is extended from the housing, and the door handle operating the latch is in a rest position.

Preferably, the end of the bolt which extends from the housing is provided with upper and lower flats. The flats may be guided by correspondingly shaped flats provided in an aperture, through which the bolt extends out of the end of the housing.

The bolt may be pushed completely into the housing and rotated through 180° in order to change the hand of the latch. A slot may be provided in the face of the bolt for receiving a tool, for example, a screwdriver blade, which may be used in assisting to change the hand of the latch.

Typically the follower, multiplier, flexible element and bolt are injection moulded in plastics. The latch housing is preferably die cast in zinc. Alternatively, the housing may be also injection moulded in plastics.

The invention will now be described by way of example only with reference to the accompanying drawings in which.

Figure 3:
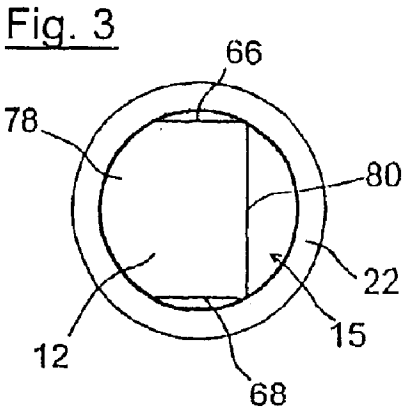
FIG. 3 is an end view of the latch of FIGS. 1 and 2, showing the bolt.
Figure 1:
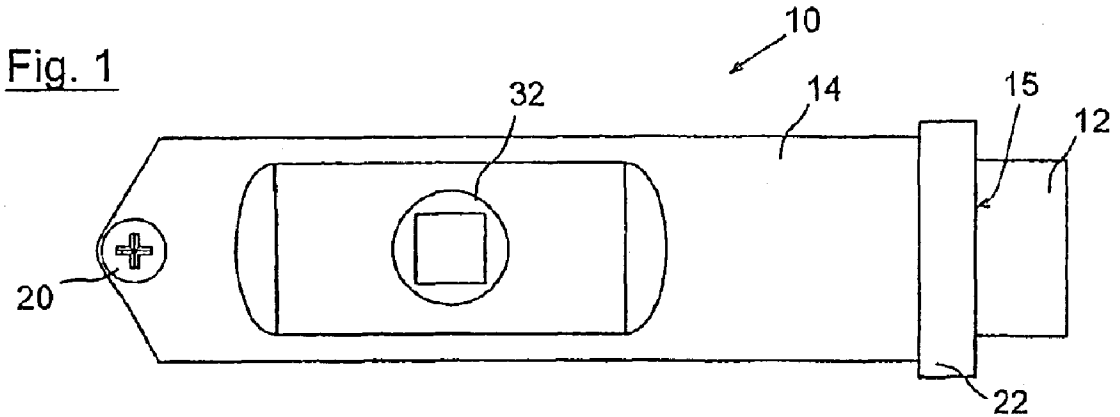
FIG. 1 shows a side view of a latch according to the invention.
Figure 2:
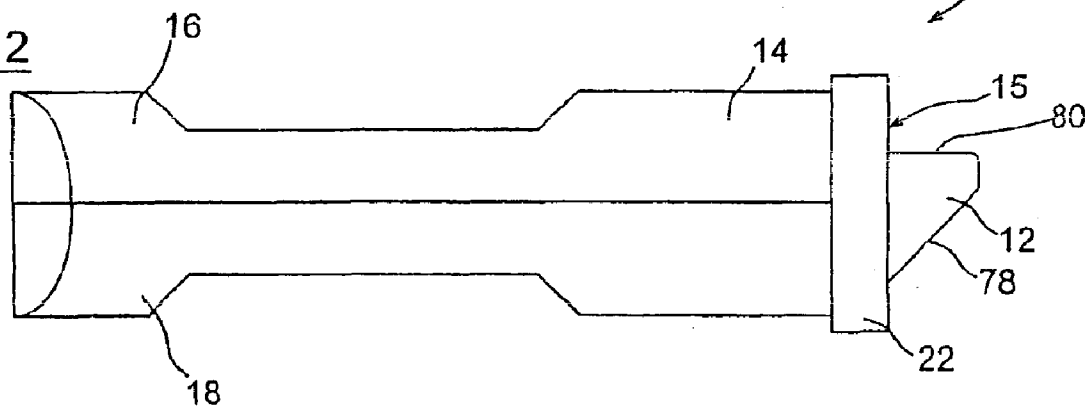
FIG. 2 shows a plan view from above of the latch as shown in FIG. 1.

Referring firstly to FIGS. 1 and 2, a door latch is indicated generally at 10. The latch 10 includes a bolt 12 which is housed in, and extends from one end of a latch housing 14 through an aperture 15. The latch housing 14 is made in two parts 16,18, shown in FIG. 2. The parts 16,18 are held together at one end by a screw 20, see FIG. 1, and at the other end by a circular ferrule 22. The ferrule 22 is internally threaded and engages with a male thread provided at the end of the parts 16,18. As seen in FIG. 3, the ferrule 22 is open ended, which allows the bolt 12 to pass through the ferrule. The ferrule 22 is of a larger external diameter than the housing 14, creating a stepped diameter, in the manner of a flange, at the end of the latch 10.

Figure 8:
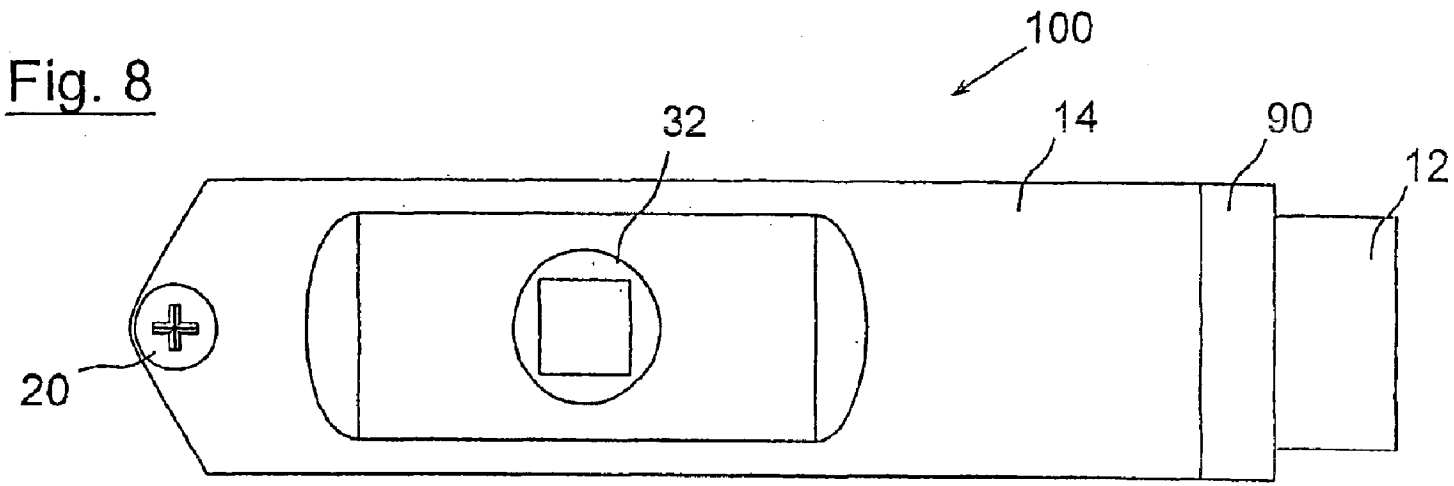
FIG. 8 is a side view of a further embodiment of a latch.

The outside of the housing 14 is generally cylindrical, and is designed to fit in a circular bore for ease of fitting to a door (not shown). Typically the bore would be 1 inch (approximately 25 mm) in diameter for a standard size domestic door latch. A circular counter bore is also provided to accommodate the ferrule 22 in the edge of the door. In an alternative and preferred embodiment of a latch 100, shown in FIG. 8, an alternative circular ferrule 90 has the same external diameter as the latch housing 14, to which it is fitted. This negates the need for a counter bore, when fitting the latch 100 in the edge of a door. The latch 100 can simply be pushed into a plane bore.

Figure 4:
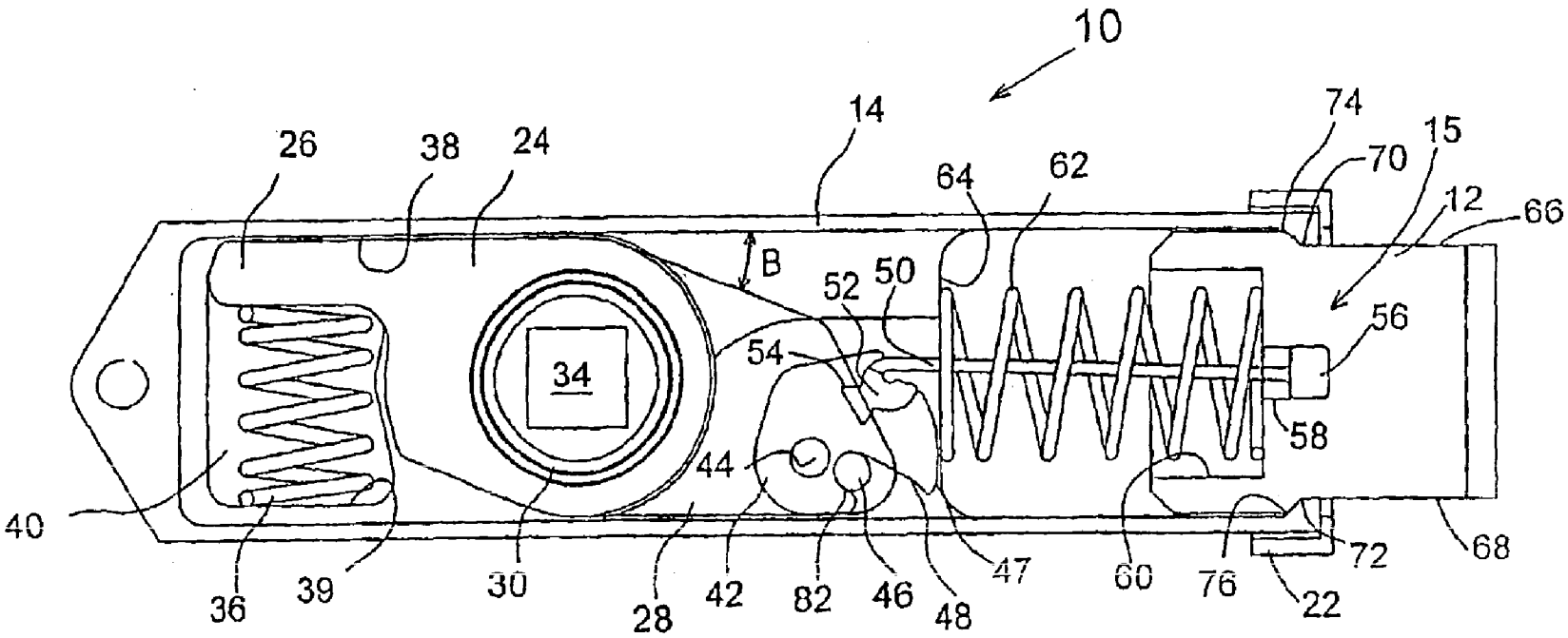
FIG. 4 is a diagrammatical cross sectional view through the latch as shown in FIGS. 1 and 2, with the latch in a closed position.

Referring now to FIG. 4, a follower 24 has a spring arm 26 and an actuating arm 28 extending from opposite sides of a central hub 30. The hub 30 is mounted for rotational movement in circular apertures provided in either side of the latch housing 14. One of the circular apertures is indicated at 32 in FIG. 1. A square aperture 34 is provided through the follower 24 in axial alignment with the hub 30 for receiving a square section latch driving spindle of a door handle (not shown) in conventional manner.

The follower 24 is mounted with the spring arm 26 located at the left hand end of the latch housing 14 as viewed, that is, at the closed end of the housing. Rotational movement of the follower 24 in the clockwise direction as viewed, is limited by engagement of the spring arm 26 against an upper inside wall 38 of the housing 14. A handle return spring 36 is located in a cavity 40, which acts between the spring arm 26 and a lower inside wall 39 of the housing 14. The spring 36 biases the follower 24 towards the limiting position shown, which corresponds to the rest position of the door handle for operating the door latch 10. A wedge (not shown) may be inserted between the spring 36 and the lower inside wall 39 of the housing 14 with the thin end of the wedge positioned pointing away from the hub 30 of the follower 24. The wedge tilts the central axis of the spring 36 allowing even compression of the spring between the upper surface of the wedge and the spring arm 26.

A multiplier 42 is mounted approximately in the middle of the housing 14 for rotational movement about a pivot 44. A guide pin 46 is mounted on the actuating arm 28 of the follower 24, which cams against a pin guide surface 48 of the multiplier 42. The pin guide surface 48 is shaped as an evolute curve for a smooth camming action, but the pin guide surface 48 may be straight (not shown). The outside edge 47 of the multiplier 42 positioned adjacent the guide pin surface 48 is shaped as an involute curve, but also may be straight (not shown). The relative movement of the guide pin 46 and multiplier 42, and the purpose of the involute outside edge 47 are described further below with reference to FIG. 5.

The multiplier 42 is connected to the bolt 12 by means of an inelastic flexible element 50. One end of the element 50 is provided with a ball or circular member 56 which is received in a socket 58 in the bolt 12. The other end of the element 50 is formed with an integral dovetail 52 which is received in a dovetail slot 54 in the multiplier 42 to form a dovetail joint. The ball or circular member 56 is located in the socket 58 during assembly of the joint as a snap fit.

A circular recess 60 is provided in the end of the bolt 12, which is concentric with and extends into the socket 58. One end of a coil spring 62, for biasing the bolt outwards of the housing 14, is located in the recess 60, and the other end of the spring 62 bears against an internal wall 64 of the housing 14. The inelastic flexible element 50 extends longitudinally within the spring 62.

The end of the bolt 12 which extends from the housing 14 is provided with upper and lower flats 66,68, also shown in FIG. 3. The flats 66,68 are guided by correspondingly shaped flats 70,72 provided in the aperture 15, and prevent rotation of the bolt 12 relative to the latch housing 14. Angled steps 74,76 formed between the flats 66,68 of the bolt 12 and the cylindrical part of the bolt 12 located in the housing 14, act as stops which abut the end of the housing 14 and limit the movement of the bolt 12 outwards of the housing.

As can be seen from FIGS. 2 and 3, the end of the bolt 12 is handed in conventional manner, one side 78 of the bolt being sloped for closing engagement with a keeper (not shown), and the other side 80 of the bolt being cut away to be received and retained by a keeper. In order to change the hand of the bolt 12 relative to the latch housing 14, the bolt 12 is pushed completely into the housing against the bias of the spring 62 and then rotated through 180°. When the bolt 12 is released, the spring 62 urges the bolt 12 back out of the housing with the flat 68 being guided by the flat 70 of the aperture 15, and the flat 66 being guided by the flat 72 of the aperture 15.

Figure 6:
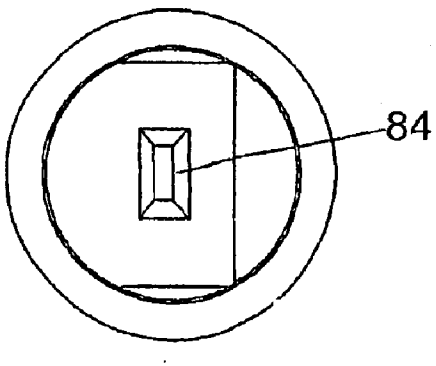
FIG. 6 is an end view of a latch incorporating a second embodiment of bolt.

In a preferred embodiment of the bolt 12, a slot 84, shown in FIG. 6, is provided in the face or side 78 of the bolt which is slop ed for closing engagement with the keeper (not shown). The slot may receive a tool, for example, a screwdriver blade, which may be used to assist in changing the hand of the latch.

The follower 24, multiplier 42, inelastic flexible element 50 and bolt 12 are preferably injection moulded in plastics. The parts of the housing 16,18 are preferably die cast in zinc. Alternatively, the parts of the housing 16,18 may also be injection moulded in plastics.

The operation of the door latch 10 will now be described with reference also to FIG. 5. The latch 10 is shown in the closed position in FIG. 4, that is, with the end of the bolt 12 extending from the housing 14 in its limited position. The handle return spring 36 is fully extended and the follower 24 is in its rest position. The square aperture 34 in the follower 24 is aligned such that a conventional handle (not shown) connected to the latch 10 is in the rest position, that is, with the handle horizontal or substantially so. The guide pin 46 is located atone end of the pin guide surface 48 and is cradled in a hook 82 of the multiplier 42.

As the door handle is depressed in order to open the door, the follower 24 is driven anticlockwise, as viewed in the direction of arrow A, about the hub 30, against the bias of the handle return spring 36. The guide pin 46 of the actuating arm 28 cams against the pin guide surface 48 of the multiplier 42, causing the multiplier to rotate anticlockwise, as viewed, about the pivot 44. The rotational movement of the follower 24 is limited to 20°, by the engagement of the actuating arm 28 with the upper inside wall 38 of the housing 14, indicated by arrow B in FIG. 4. However, the action of the guide pin 46 on the pin guide surface 48 amplifies the rotational movement of the follower 24, causing the multiplier 42 to rotate through at least 60°. The evolute curve of the multiplier 42 has the effect of smoothing the camming action, and of amplifying the rotational movement of the multiplier 42 even further than if the pin guide surface 48 were straight (not shown).

The rotation of the multiplier 42 causes the inelastic flexible element 50 to wrap around the outside edge 47 of the multiplier 42, and pulls the bolt 12 into the housing 14 against the bias of the spring 62. The rotational movement of the multiplier 42 is thereby converted to rectilinear movement of the bolt 12, indicated by arrow C. The outside edge 47 of the multiplier 42 is shaped as an involute curve in order to maximise the amount of rectilinear movement available for the amount of rotational movement of the multiplier 42.

Figure 5:
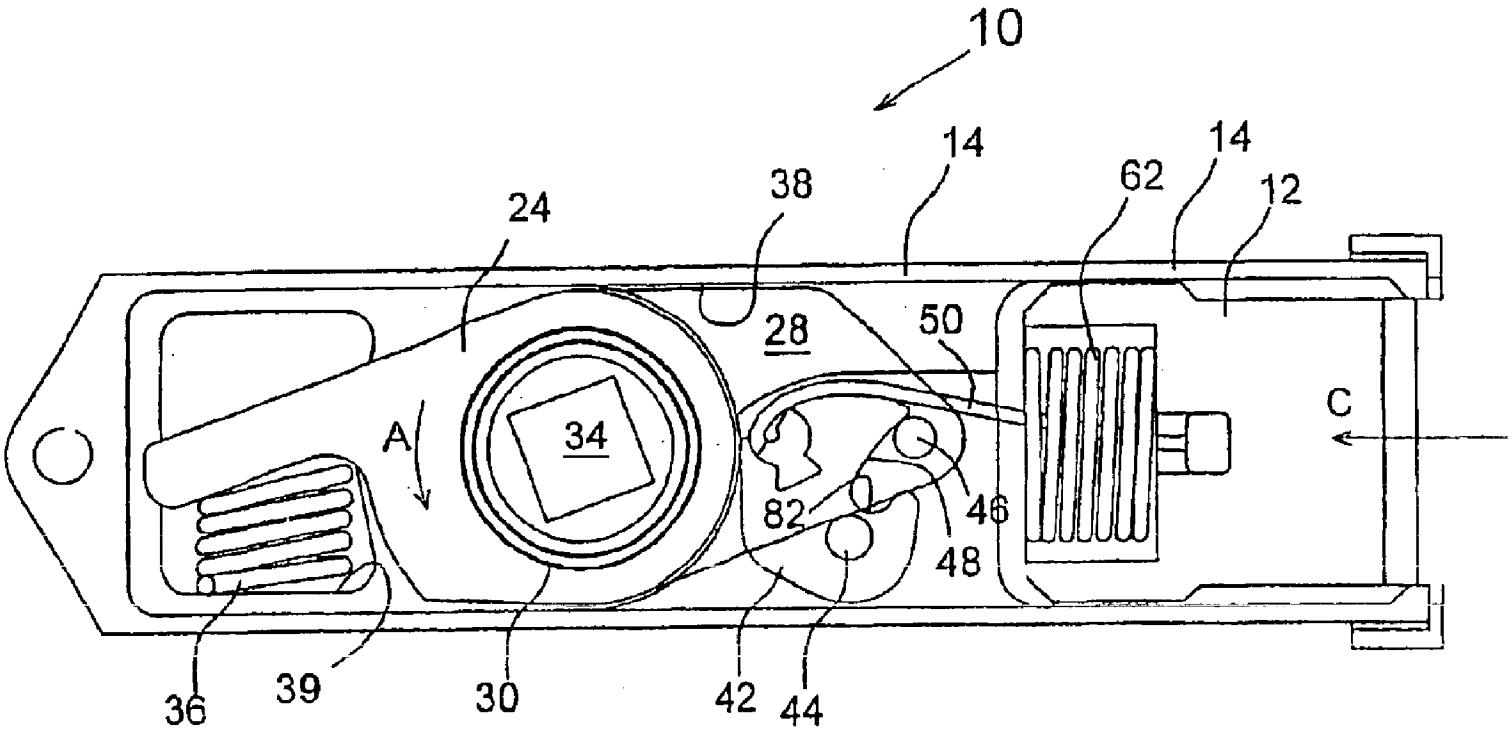
FIG. 5 is a diagrammatical cross sectional view through the latch as shown in FIGS. 1 and 2, with the latch in an open position.

The door latch 10 can be seen with the follower 24 and multiplier 42 at the limit of their rotational movement in FIG. 5, the guide pin 46 having cammed along the pin guide surface 48, and the inelastic flexible element 50 having wrapped around the involute curve 47 of the multiplier 42. Both the handle return spring 36 and spring 62 for biasing the bolt 12 outwards of the housing 14 are compressed. When the handle is released, the spring 62 forces the bolt 12 out of the housing 14, which pulls the inelastic flexible element 50 in the opposite direction away from the multiplier and causing the multiplier to rotate clockwise, as viewed, back to the rest position. The handle return spring 36 returns the follower 24 and hence the handle, back to their rest positions.

When the bolt 12 is pushed into the housing 14, either to change the hand of the bolt, or when the bolt engages a keeper as the door is slammed shut, the inelastic flexible element 50 simply bends to accommodate the movement. As the movement of the follower 24 is limited to 20° of rotation, the door handle need only be moved through an arc of 20° in order to release the bolt 12 and open the door. Therefore, the door latch 10 of the invention significantly reduces the handle movement required in opening a conventional door latch, for easier operation.

Figure 7:
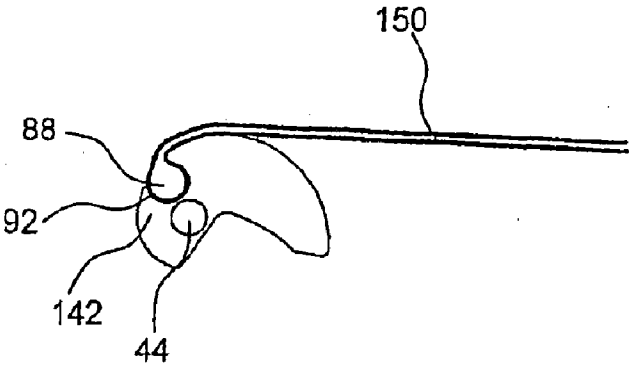
FIG. 7 is a side view of an alternative embodiment of multiplier and inelastic flexible element for use in a latch in accordance with the invention.

An alternative embodiment of multiplier 142 and inelastic flexible element 150 is shown in FIG. 7. The end of the inelastic flexible element 150 is provided with a substantially circular enlargement 88, which is received and retained in a correspondingly shaped recess 92 in the multiplier 142. The circular enlargement 88 is a clearance fit in the recess 92, and hence is able to rotate to a limited degree to align itself to the direction of any applied forces. This substantially reduces the stresses present at the position where the circular enlargement 88 necks into the length of the inelastic flexible element 150, and consequently improves the durability of the in elastic flexible element 150 in use.

What is claimed is:

1. A door latch comprising a follower mounted for rotational movement in a latch housing, a multiplier operatively linked to the follower for amplifying rotational movement of the follower, a bolt biased outwards of the housing, and an inelastic flexible element connected between the multiplier and bolt for converting rotational movement of the multiplier to rectilinear movement of the bolt in which the follower comprises a spring arm and an actuating arm extending from opposite sides of a central hub.

2. A door latch as claimed in claim 1 in which the hub locates in circular apertures provided in either side of the latch housing.

3. A door latch as claimed in claim 1 in which a guide pin is mounted on the actuating arm of the follower, and the multiplier is provided with a pin guide surface.

4. A door latch as claimed in claim 3 in which the pin guide surface is curved.

5. A door latch as claimed in claim 1 in which the multiplier is mounted for rotation about a pivot.

6. A door latch as claimed in claim 1 in which one end of the inelastic flexible element is provided with a ball or cylindrical member, which engages in a socket provided in the bolt.

7. A door latch as claimed in claim 6 in which the other end of the inelastic flexible element is provided with a substantially circular enlargement, which is received and retained in a correspondingly shaped recess in the multiplier.

8. A door latch as claimed in claim 1 in which a square aperture is provided through the follower for receiving a latch driving spindle of a handle.

9. A door latch as claimed in claim 6 in which a circular recess is provided in the end of the bolt, which receives a spring for biasing the bolt outwards of the housing.

10. A door latch as claimed in claim 9 in which the socket extends from the circular recess.

11. A door latch as claimed in claim 1 in which in use during opening of the latch, the inelastic flexible element wraps around an outside edge of the multiplier.

12. A door latch as claimed in claim 1 in which the end of the bolt which extends from the housing is provided with upper and lower flats.

13. A door latch as claimed in claim 12 in which the flats of the bolt are guided by corresponding shaped flats provided in an aperture in the end of the housing.

14. A door latch as claimed in claim 1 in which the bolt can be pushed completely into the housing and rotated through 180° in order to change the hand of the latch.

15. A door latch as claimed in claim 1 in which the housing is assembled from at least two parts, and a ferrule of larger external diameter than the parts, which forms a stepped diameter at the end of the latch.

* * * * *